US010668716B2

(12) United States Patent
Rieck

(10) Patent No.: US 10,668,716 B2
(45) Date of Patent: Jun. 2, 2020

(54) TRANSFER FILM HAVING A ROLLER CLEANING SECTION

(71) Applicant: ASSA ABLOY AB, Stockholm (SE)

(72) Inventor: James Rieck, Brooklyn Park, MN (US)

(73) Assignee: ASSA ABLOY AB, Stockholm (SE)

( * ) Notice: Subject to any disclaimer, the term of this patent is extended or adjusted under 35 U.S.C. 154(b) by 0 days.

(21) Appl. No.: 16/483,946

(22) PCT Filed: Nov. 28, 2017

(86) PCT No.: PCT/IB2017/057453
§ 371 (c)(1),
(2) Date: Aug. 6, 2019

(87) PCT Pub. No.: WO2018/146532
PCT Pub. Date: Aug. 16, 2018

(65) Prior Publication Data

US 2020/0001597 A1 Jan. 2, 2020

Related U.S. Application Data

(60) Provisional application No. 62/455,689, filed on Feb. 7, 2017.

(51) Int. Cl.
*B41J 2/00* (2006.01)
*B41J 29/17* (2006.01)
*B41J 2/005* (2006.01)

(52) U.S. Cl.
CPC ..... *B41J 2/0057* (2013.01); *B41J 29/17* (2013.01)

(58) Field of Classification Search
CPC ..... B41J 2/0057; B41J 29/17
See application file for complete search history.

(56) References Cited

U.S. PATENT DOCUMENTS 5,926,197 A * 7/1999 Kessler ..... B41J 29/17 347/171
6,908,240 B1 6/2005 Johnson et al.
7,274,384 B2 * 9/2007 Conwell ..... B41J 2/32 347/221
8,079,105 B2 12/2011 Squires et al.
(Continued)

FOREIGN PATENT DOCUMENTS

CN 1314846 9/2001
CN 1894105 1/2007
(Continued)

OTHER PUBLICATIONS

"International Application Serial No. PCT/IB2017/057453, International Search Report dated Mar. 12, 2018", 5 pgs.
(Continued)

*Primary Examiner* — Jason S Uhlenhake
(74) *Attorney, Agent, or Firm* — Schwegman Lundberg & Woessner, P.A.

(57) ABSTRACT

A transfer ribbon (120) includes at least one print section (198) and one or more roller cleaning sections (190). Each print section (198) includes a print intermediate. Each of the one or more roller cleaning sections (190) includes an adhesive layer (192). The one or more roller cleaning sections (190) include a roller cleaning section at a trailing end of the transfer ribbon, and/or a roller cleaning section at a leading end of the transfer ribbon.

15 Claims, 4 Drawing Sheets

(56) References Cited

U.S. PATENT DOCUMENTS

| | | | | |
|---|---|---|---|---|
| 8,169,644 | B2 | 5/2012 | Katsuno et al. | |
| 9,403,375 | B1 | 8/2016 | Stangler et al. | |
| 2005/0128280 | A1 * | 6/2005 | Johnson | B41J 2/32 347/187 |

FOREIGN PATENT DOCUMENTS

| | | | |
|---|---|---|---|
| CN | 201140569 | | 10/2008 |
| CN | 101304817 | | 11/2008 |
| EP | 1108551 | A1 | 6/2001 |
| EP | 0783978 | | 7/2013 |
| JP | S60212379 | | 10/1985 |
| JP | H01242278 | A | 9/1989 |
| JP | H10100454 | | 4/1998 |
| JP | 2002166666 | | 6/2002 |
| WO | 9321020 | | 10/1993 |
| WO | WO-2018146532 | A1 | 8/2018 |

OTHER PUBLICATIONS

"International Application Serial No. PCT/IB2017/057453, Written Opinion dated Mar. 12, 2018", 6 pgs.
"Chinese Application Serial No. 201780085774.0, Office Action dated Feb. 25, 2020", w/o English Translation, 8 pgs.

* cited by examiner

TRANSFER FILM HAVING A ROLLER CLEANING SECTION

PRIORITY APPLICATIONS

This application is a national stage application of International PCT Appl. No. PCT/IB2017/057453, filed Nov. 28, 2017, titled "TRANSFER FILM HAVING A ROLLER CLEANING SECTION," which claims priority to U.S. Provisional Appl. No. 62/455,689, filed Feb. 7, 2017, titled "TRANSFER FILM HAVING A ROLLER CLEANING SECTION," each of which is hereby incorporated herein by reference in its entirety.

BACKGROUND

Credentials include identification cards, driver's licenses, passports, and other documents. Such credentials are formed from credential or card substrates including paper substrates, plastic substrates, cards, and other materials. Such credentials generally include printed information, such as a photo, account numbers, identification numbers, and other personal information. Credentials can also include data that is encoded in a smartcard chip, a magnetic stripe, or a barcode, for example.

Credential production devices include processing devices that process credential substrates by performing at least one processing step in forming a final credential product. Such processes generally include a printing process, a laminating or transfer process, a data reading process, a data writing process, and/or other process used to form the desired credential.

In a transfer or reverse-image printing process, a printing device, such as a thermal or ink jet print head, is used to perform a print operation, in which an image is printed to a surface of a print intermediate. The print intermediate is commonly supported on a backing or carrier layer to form a transfer ribbon. The print intermediate is typically one of two types: a patch laminate, or a fracturable laminate or transfer layer often referred to as a "thin film laminate." The patch laminate is generally a pre-cut polyester film that has been coated with a thermal adhesive on one side. Thin film laminates or transfer layers are fracturable laminates that are generally formed of a continuous resinous material that is coated onto the polyester carrier or backing layer. The side of the resin material that is not attached to the continuous carrier layer is generally coated with a thermal adhesive which is used to create a bond between the resin and a surface of a substrate.

After the image is printed to the print intermediate, the printed image is registered with the substrate. Next, a laminating device is used to perform a lamination operation, during which the imaged print intermediate is transferred to the surface of the substrate. Typical laminating devices include a heated laminating or transfer roller that activates and presses the adhesive of the print intermediate against the surface of the substrate to bond the print intermediate to the surface. The carrier or backing layer is then removed to complete the transfer printing process leaving the imaged print intermediate attached to the substrate.

Cleaning operations may be performed in credential production devices. U.S. Pat. No. 8,079,105 (Squires et al.) discloses a card cleaning mechanism that operates to clean side surfaces of a card substrate prior to processing the card substrate. U.S. Pat. No. 7,274,384 (Conwell) discloses a print head cleaning technique that utilizes an abrasive cleaning strip.

SUMMARY

Embodiments of the present disclosure are directed to a transfer ribbon, and a method of cleaning a surface of a feed roller in a credential production device. One embodiment of the transfer ribbon includes at least one print section and one or more roller cleaning sections. Each print section includes a print intermediate. Each of the one or more roller cleaning sections includes an adhesive layer. The one or more roller cleaning sections each include a roller cleaning section at a trailing end of the transfer ribbon, and/or a roller cleaning section at a leading end of the transfer ribbon.

In one embodiment of the method, a transfer ribbon is fed through a credential production device using one or more feed rollers in a feed direction. The transfer ribbon includes at least one print section having a print intermediate, and one or more roller cleaning sections each having an adhesive layer. The one or more roller cleaning sections include at least one of a roller cleaning section at a trailing end of the transfer ribbon relative to the feed direction, and a roller cleaning section at a leading end of the transfer ribbon relative to the feed direction. The surface of one of the feed rollers is cleaned during the feeding of the transfer ribbon by engaging a surface of the feed roller with the adhesive layer of a first one of the one or more roller cleaning sections during rotation of the feed roller, and removing contaminants from the surface of the feed roller using the adhesive layer.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
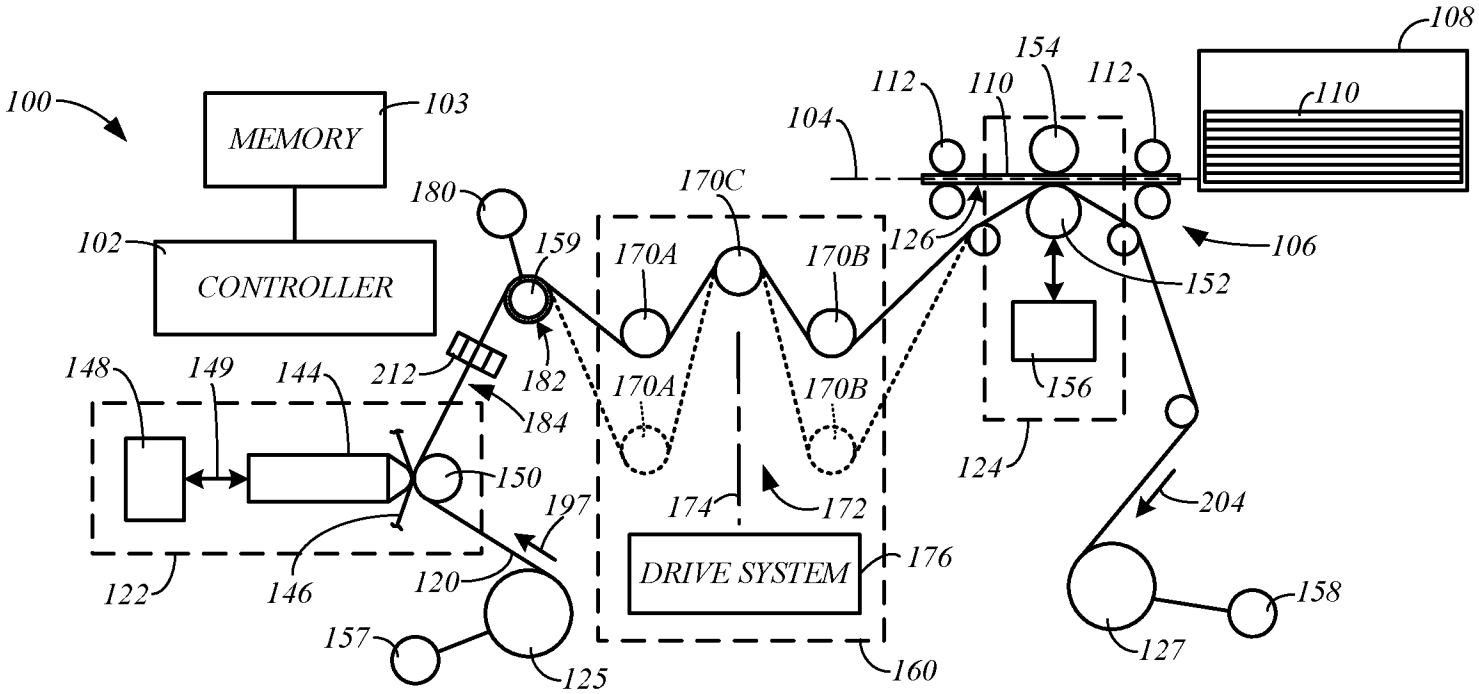
FIG. 1 is a simplified block diagram of an exemplary credential production device in accordance with embodiments of the present disclosure.

FIG. 1 is a simplified block diagram of an exemplary credential production device 100 in accordance with embodiments of the present disclosure. In some embodiments, the device 100 includes a controller 102 representing one or more processors that are configured to execute program instructions stored in a computer-readable media or memory 103 of the device or other location. Any suitable patent subject matter eligible computer readable media or memory may be utilized including, for example, hard disks, CD-ROMs, optical storage devices, flash memory, or magnetic storage devices, or other suitable computer readable media or memory. Such computer readable media or memory do not include transitory waves or signals. The execution of the instructions by the controller 102 controls components of the device 100 to perform functions and method steps described herein.

In some embodiments, the device 100 includes a processing path 104, a transport mechanism 106, and a substrate supply 108. The substrate supply 108 may be in the form of a container or cartridge that is configured to contain individual substrates 110. The substrates 110 are individually fed from the supply 108 along the processing path 104, which is parallel to the processing path 104, for processing using the transport mechanism 106, which is controlled by the controller 102. In some embodiments, the transport mechanism 106 includes one or more motorized feed rollers or feed roller pairs 112, or other suitable mechanism. Sensors may be used to assist the controller 102 in the feeding of the substrates 110 along the processing path 104, and aligning the substrates 110 with substrate processing devices along the processing path 104.

The substrates 110 may take on many different forms, as understood by those skilled in the art. In some embodiments, the substrate 110 is a credential substrate. As used herein, the term "credential substrate" includes substrates used to form credentials, such as identification cards, membership cards, proximity cards, driver's licenses, passports, credit and debit cards, and other credentials or similar products. Exemplary card substrates include paper substrates other than traditional paper sheets used in copiers or paper sheet printers, plastic substrates, rigid and semi-rigid card substrates, and other similar substrates.

In some embodiments, the device 100 is configured to perform a transfer printing process or reverse-image printing process to print an image to the substrate 110. In some embodiments, the device includes a transfer ribbon 120, a printing device 122, and a laminating device 124. The printing device 122 is configured to print an image to a print intermediate of the transfer ribbon 120. The laminating device 124 is configured to transfer printed images from the print intermediate of the transfer ribbon 120 to a surface 126 of the substrate 110.

In some embodiments, the print intermediate is supported on a transfer ribbon 120 that is wound between a supply spool 125 and a take-up spool 127, and extends through the printing device 122 and the laminating device 124, as shown in FIG. 1. The transfer ribbon 120 is configured to receive images that are printed using the printing device 122 and transfer the printed images to the surface 126 of the substrate 110 using the laminating device 124.

Figure 2:
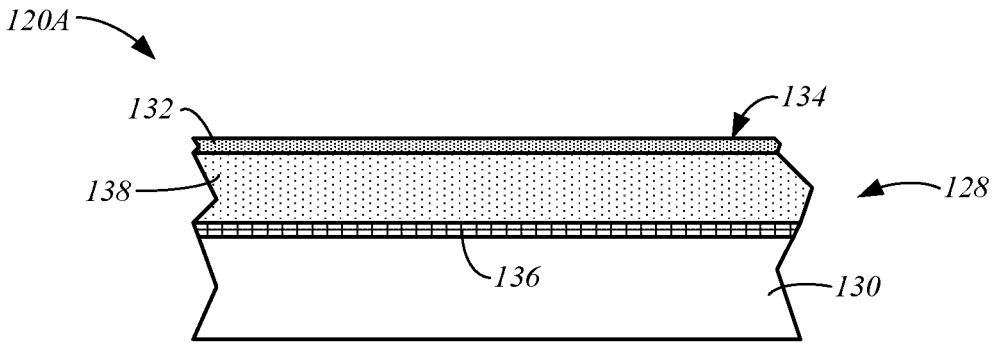
FIG. 2 is a simplified cross-sectional view of a portion of an exemplary transfer ribbon that includes a print intermediate in the form of a transfer layer, in accordance with embodiments of the present disclosure.

FIG. 2 is a simplified side cross-sectional view of a section of an exemplary transfer ribbon 120A having a print intermediates or print sections in the form of a transfer layer 128, in accordance with embodiments of the present disclosure. In some embodiments, the transfer layer 128 is attached to a backing or carrier layer 130. In some embodiments, the transfer layer 128 is in the form of a fracturable laminate or thin film laminate. In some embodiments, the transfer layer 128 includes a thermal adhesive 132, which is activated during a transfer lamination process using the laminating device 124 to bond a section of the transfer layer 128 to the surface 126 of the substrate 110. In some embodiments, the transfer layer 128 includes an image receptive surface 134 on the thermal adhesive 132 that is configured to receive an image that is printed using the printing device 122 during a print operation. The transfer ribbon 120A may also include a release layer 136 between the transfer layer 128 and the carrier layer 130 that assists in releasing the transfer layer 128 from the carrier layer 130 during a transfer lamination process.

In some embodiments, the transfer layer 128 includes a protective layer 138 located between the adhesive layer 132 and the carrier layer 130. Alternatively, the protective layer 138 may be combined with the adhesive layer 132. The protective layer 138 operates to provide protection to the surface 126 of the substrate 110 to which the transfer layer 128 is laminated. The protective layer 138 may also protect an image printed on the image receptive surface 134 when the transfer layer 128 is laminated to a surface 126 of a substrate 110. Other conventional materials or layers may also be included in the transfer ribbon 120A and the transfer layer 128.

Figure 3:
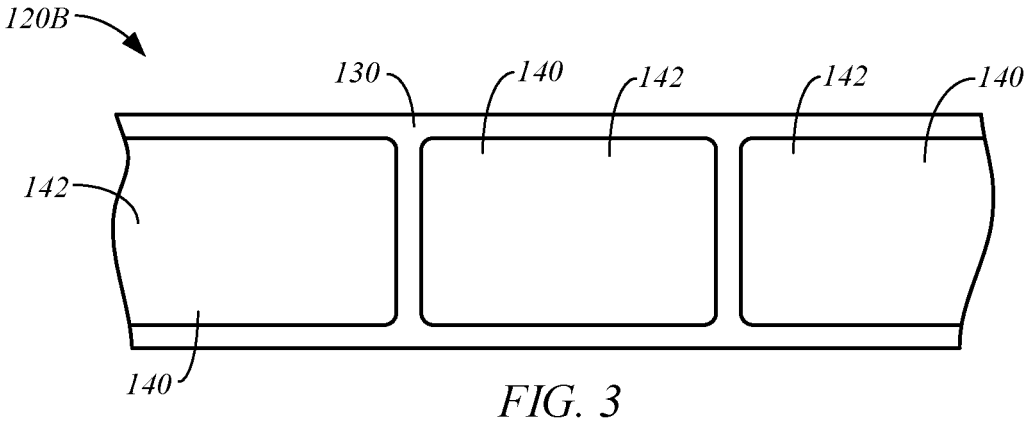
FIG. 3 is a simplified top view of a portion of an exemplary transfer ribbon that includes print intermediates in the form of overlaminate patches, in accordance with embodiments of the present disclosure.

FIG. 3 is a simplified top view of an exemplary transfer ribbon 120B having print intermediates or print sections in the form of overlaminate patches 140, in accordance with embodiments of the present disclosure. The overlaminate patches 140 are attached to a backing or carrier layer 130. Each overlaminate patch 140 includes an exposed surface 142 having a layer of thermal adhesive, which is activated by the laminating device during a transfer lamination operation to bond the patch 140 to the surface 126 of a substrate. Each overlaminate patch 140 is formed of a polyester film or other suitable material that provides protection to the surface 126 of the substrate 110. In some embodiments, the surface 142 includes an image receptive material that is adapted to receive an image printed using the printing device 122. Other conventional materials or layers may also be included in the transfer ribbon 120B and the patches 140.

The printing device 122 is configured to print an image to the transfer ribbon 120 and, more specifically, to a print intermediate of the transfer ribbon 120, such as the transfer layer 128 of the transfer ribbon 120A (FIG. 2) or the patch 140 of the transfer ribbon 120B (FIG. 3). In some embodiments, the printing device 122 includes a print head 144. In some embodiments, the print head 144 is a conventional thermal print head and the printing device 122 includes a thermal print ribbon 146, as shown in FIG. 1. In some embodiments, the thermal print head 144 includes a plurality of heating elements that heat the print ribbon 146 and cause dye, resin, and/or other print materials to transfer to the print intermediate of the transfer ribbon 120 to form the desired image on the print intermediate, in accordance with conventional techniques.

In some embodiments, the print head 144 is an ink jet print head 144, which applies ink to the print intermediate of the transfer ribbon 120 to produce a desired image on the print intermediate. In this case, the print ribbon 146 is not used.

In some embodiments, the printing device 122 includes a print head lift mechanism 148 that is configured to move the print head 144 relative to the transfer ribbon 120, as indicated by arrow 149. In some exemplary embodiments, the lift mechanism 148 moves the print head 144 between a retracted position (not shown), in which the print head 144 is disengaged from the transfer ribbon 120, and a print position, in which the print head 144 presses the print ribbon 146 against the transfer ribbon 120 under the support of support member 150, such as a platen roller or another suitable support member, as shown in FIG. 1.

The laminating device 124 is configured to perform a transfer or lamination operation, during which an imaged print intermediate is transferred from the transfer ribbon 120 to the surface 126 of the substrate 110. Some embodiments of the laminating device 124 include a laminating or transfer roller 152 that is configured to heat the print intermediate supported by the transfer ribbon 120, and press the print intermediate against the surface 126 of the substrate 110. This heating activates the thermal adhesive of the print intermediate, which causes the print intermediate to bond to the surface 126 of the substrate 110. In some embodiments, the laminating device 124 includes a platen roller 154 that provides support for the substrate 110 during the lamination operation.

In some embodiments, the laminating device 124 includes a lift mechanism 156 that is configured to move the transfer roller 152 relative to the processing path 104. In some embodiments, the lift mechanism 156 is configured to move the transfer roller 152 between a retracted position (not shown), in which the transfer roller 152 is displaced from the processing path 104 and a substrate 110 in the processing path, and a laminating position, in which the transfer roller 152 presses the transfer ribbon 120 against the surface 126 of a substrate 110 supported in the processing path 104 by the platen roller 154, as shown in FIG. 1.

In some embodiments, the device 100 includes transfer ribbon feeding components that are configured to feed the transfer ribbon 120 through the printing device 122 and through the laminating device 124. The transfer ribbon feeding components can take on many different forms. In some embodiments, the transfer ribbon feeding components include a motor 157 that is configured to drive rotation of the supply spool 125, and/or a motor 158 is configured to drive rotation of the take-up spool 127, as shown in FIG. 1. In some embodiments, the transfer ribbon feeding components include one or more motorized feed rollers 159.

In some embodiments, the transfer ribbon feeding components are controlled by the controller 102 and allow for independent feeding of the transfer ribbon 120 through the printing device 122 and the laminating device 124. Thus, during a print operation, the controller 102 controls the feeding of the transfer ribbon 120 through the printing device 122 using one or more of the transfer ribbon feeding components to facilitate the performance of a print operation using the print head 144 to print an image to the transfer ribbon 120.

Similarly, the controller 102 controls the feeding of the transfer ribbon 120 through the laminating device 124 during a lamination operation using one or more of the transfer ribbon feeding components, such as the motorized feed rollers 159, to transfer a printed image from the transfer ribbon 120 to the surface 126 of the substrate 110. In some embodiments, this allows the device 100 to perform printing and lamination operations independently from each other. Thus, in some embodiments, the printing device 122 and the laminating device 124 can simultaneously perform print and lamination operations, respectively. As a result, the device 100 is capable of performing transfer printing operations more efficiently than transfer printing operations performed by conventional credential production devices.

In some embodiments, the device 100 includes a transfer ribbon accumulator 160, which is configured to take-up or reduce slack in the transfer ribbon 120 that is generated in response to the independent feeding of the transfer ribbon 120 by the devices 122 and 124 during print and lamination operations. One exemplary accumulator is disclosed in U.S. Pat. No. 9,403,375 (Stangler et al.), which is hereby incorporated by reference in its entirety.

In some embodiments, the transfer ribbon accumulator 160 includes multiple ribbon-engaging members (REM's), which are generally referred to as 170. The REM's 170 can each take on any suitable form, such as a roller, a bar, a guide member, or other suitable component. In some embodiments, one or more of the REM's 170 are feed rollers, such as in the form of the feed roller 159, for example. In some embodiments, the accumulator 160 includes at least REM's 170A-C, as shown in FIG. 1. In some embodiments, REM's 170A and 170B have fixed positions relative to each other and are separated by a gap 172. The REM 170C is aligned with an axis that extends between the gap 172.

The length of the path the transfer ribbon 120 travels through the accumulator 160 can be adjusted by adjusting the relative positions of the REM's 170A and 170B and the REM 170C using a drive system 176. For example, the REM's 170A and 170B can be moved away from the REM 170C along the axis 174 using the drive system 176 to increase the length of transfer ribbon 120 within the accumulator 160, as indicated in phantom lines. Likewise, the REM's 170A and 170B can be moved closer to the REM 170C along the axis 174 using the drive system 176 to decrease the length of the transfer ribbon 120 within the accumulator 160. In one alternative configuration, the REM 170C is configured to move along the axis 174 relative to the REM's 170A and 170B using the drive system 176.

The drive system 176 may take on any suitable form and include one or more motors, gears, and/or other suitable components. The force applied by the drive system 176 maintains a desired tension in the transfer ribbon 120 during print and/or lamination operations. The displacement between at least the REM 170C and the REM's 170A and 170B in response to the force applied by the drive system 176 is adjusted automatically to either increase or decrease the length of the path the transfer ribbon 120 is routed through the accumulator 160. This allows the accumulator 160 to accommodate different rates at which the accumulator 160 receives and discharges the transfer ribbon 120.

When the rate at which the transfer ribbon 120 is fed into the accumulator is greater than the rate at which the transfer ribbon 120 is fed out of the accumulator 160, the tension applied by the drive system 176 causes an increase in the displacement between the REM 170C and the REM's 170A and 170B along the axis 174, which increases the length of the path the transfer ribbon 120 travels through the accumulator. This increase in the path of the transfer ribbon 120 through the accumulator 160 allows the accumulator to increase the length of the transfer ribbon 120 that it accommodates to take up slack that would otherwise form in the transfer ribbon 120.

When the rate at which the transfer ribbon 120 is fed into the accumulator is less than the rate at which the transfer ribbon 120 is fed out of the accumulator 160, the force applied by the drive system 176 is overcome by an increase in tension in the transfer ribbon 120. This causes a decrease in the displacement between the REM 170C and the REM's 170A and 170B along the axis 174, which decreases the length of the path the transfer ribbon 120 travels through the accumulator. This decrease in the path of the transfer ribbon 120 through the accumulator 160 accommodates the discharge of the transfer ribbon 120 at a greater rate than the rate at which the transfer ribbon 120 is fed into the accumulator 160.

As mentioned above, the credential production device 100 includes transfer ribbon feeding components that are controlled by the controller 102 to feed the transfer ribbon 120 through the device 100, such as one or more motorized feed rollers, for example. In some embodiments, the device 100 includes one or more motorized feed rollers that are separate from the printing device 122 and the laminating device 124, such as, for example, one or more feed rollers 159, and one or more REM's 170, as shown in FIG. 1. In some embodiments, the printing device 122 and/or the laminating device 124 include one or more motorized feed rollers. In some embodiments, the platen 150 of the printing device 122 and/or the platen 152 of the laminating device 124 may be motorized and operate as motorized feed rollers. Embodiments of the feed roller 159 described herein also apply to these and other motorized feed rollers that may be included in the device 100.

Figure 4:
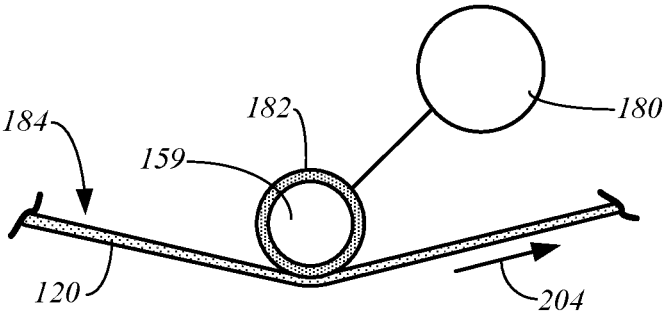
FIG. 4 is a simplified side view of an exemplary feed roller in accordance with embodiments of the present disclosure.

FIG. 4 is a simplified side view of an exemplary feed roller 159 in accordance with embodiments of the present disclosure. In some embodiments, the rotation of the feed roller 159 is driven by a motor 180 through a suitable arrangement, which may include gears, belts, or other suitable arrangement. The motor 180 is controlled by the controller 102 to control the feeding of the transfer ribbon 120 by the feed roller 159.

In some embodiments, each feed roller 159 includes an exterior surface 182 that engages a side 184 of the transfer ribbon 120. In some embodiments, the transfer ribbon 120 is partially wrapped around the surface 182 of the feed roller 159.

To precisely control the feeding of the transfer ribbon 120 through the device 100 using the one or more feed rollers of the device 100, it is important that each feed roller securely grip the side 184 of the transfer ribbon 120. In some embodiments, the surface 182 of each feed roller has a high coefficient of friction, such as greater than 1.0, for example. In some embodiments, the surface 182 has a textured surface, such as a knurled surface. In some embodiments, the surface 182 is formed of rubber, silicon carbide, tungsten carbide, aluminum oxide, and textured steel. Thus, the surface 182 enables the feed roller 159 to grip the side 184 of the transfer ribbon 120, and drive movement of the transfer ribbon 120 through the device 100.

During use, contaminants, such as dust and other debris, can collect on the surface 182 of each of the feed rollers 159, which reduces the frictional resistance between the surface 182 of the feed roller 159 and the side 184 of the ribbon 120. Over time, the frictional resistance between the surfaces 182 and the side 184 of the ribbon 120 drop below a threshold, at which slippage between the surfaces 182 and the side 184 of the transfer ribbon 120 may occur. Such slippage is undesirable as it reduces the ability of the controller 102 to precisely control the feeding of the transfer ribbon 120 through the device 100 using the one or more feed rollers, such as feed rollers 159, for example.

Some embodiments are directed to techniques for periodically removing contaminants from the surface 182 of the one or more feed rollers of the device 100. In some embodiments, the transfer ribbon 120 is configured to clean the surface 182 of the one or more feed rollers 159 during use of the transfer ribbon 120 in the device 100.

Figure 5:
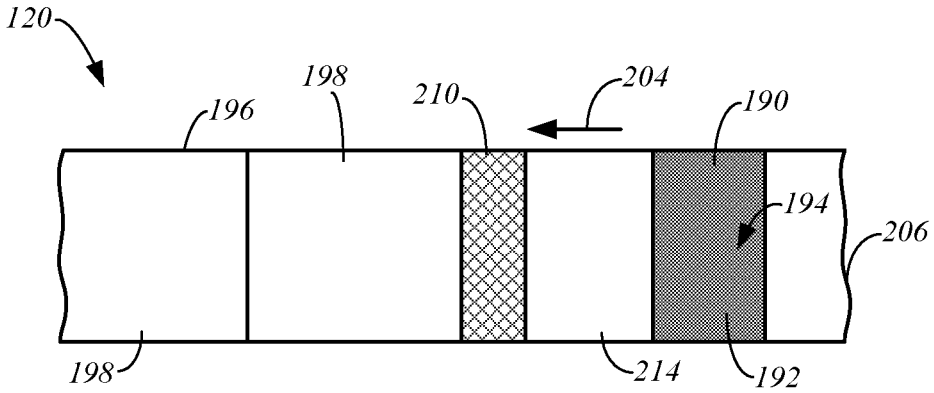
FIG. 5 is a simplified top view of a transfer ribbon in accordance with exemplary embodiments of the present disclosure.
Figure 6:
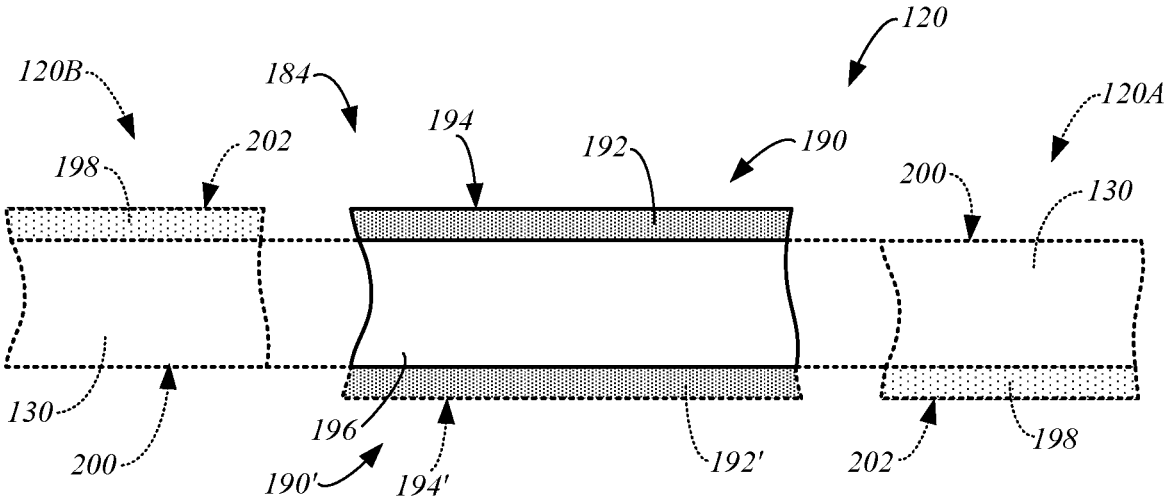
FIG. 6 is a simplified side cross-sectional view of a roller cleaning section of a transfer ribbon, in accordance with exemplary embodiments of the present disclosure.

FIG. 5 is a simplified top view of a transfer ribbon 120 in accordance with exemplary embodiments of the present disclosure. In some embodiments, the transfer ribbon 120 includes one or more roller cleaning sections 190, each of which is configured to engage the exterior surface of the one or more feed rollers, such as surface 182 of the feed roller 159, as the transfer ribbon 120 is fed through the device 100. FIG. 6 is a simplified side cross-sectional view of the roller cleaning section 190 of the transfer ribbon 120, in accordance with exemplary embodiments of the present disclosure.

In some embodiments, the roller cleaning section 190 includes an adhesive layer 192 having an exposed surface 194 on the side 184 of the transfer ribbon 120, as shown in FIG. 6. Each adhesive layer 192 is supported on a carrier layer 196. In some embodiments, the carrier layer 130 of the transfer ribbon 120 forms the carrier layer 196. Alternatively, the roller cleaning section 190 may be a separate section that is attached to the carrier layer 130 using any suitable technique, such as adhering the carrier layer 196 to the carrier layer 130 with an adhesive, or another suitable technique.

A feed roller cleaning operation is generally performed using the transfer ribbon 120 by feeding the transfer ribbon 120 through the device 100, such that the adhesive layer 192 of at least one roller cleaning section 190 engages the surfaces of one or more feed rollers, such as the surface 182 of the feed roller 159, shown in FIG. 4. Contaminants, such as dust and debris, on the surfaces of the one or more feed rollers adhere to the adhesive layer 192 during the feeding of the transfer ribbon 120.

In some embodiments, the side 184 of the transfer ribbon 120 having the exposed surface 194 of the adhesive layer 192 corresponds to an opposing side of the transfer ribbon 120 on which the print sections (e.g., transfer layers 128 or patches 140), generally referred to as 198, are located. Thus, as indicated by exemplary transfer ribbon portion 120A (shown in phantom lines), the side 184 of the transfer ribbon may include a cleaning section 190 having an exposed surface 194, and an exposed surface 200 of the carrier layer 130, while the opposing side of the transfer ribbon 120 includes the print sections 198 having an exposed surface 202, which may correspond to the surface 134 of the transfer layer 128 (FIG. 2), or the surface 142 of the patch 140 (FIG. 3), for example. Alternatively, as indicated by exemplary transfer ribbon portion 120B (shown in phantom lines), the side 184 having the exposed surface 194 of the adhesive layer 192 may include the print sections 198 having an exposed surface 202, while the opposing side includes the exposed surface 200 of the carrier layer 130.

In one embodiment, the transfer ribbon 120 includes cleaning sections 190 located on both sides of the transfer ribbon. For example, the transfer ribbon 120 may include one or more cleaning sections 190 on side 184, and one or more cleaning sections 190' located on the side opposite side 184 having an adhesive layer 192' and an exposed surface 194', as shown in FIG. 6. This is useful when the feed rollers 159 of the device 100 engage both sides of the transfer ribbon 120. Additionally, this embodiment allows the ribbon 120 to accommodate different devices 100, which may include feed rollers 159 that engage different sides of the transfer ribbon 120.

In some embodiments, each roller cleaning section 190 has a length measured in the feed direction 204 (FIG. 5) of the transfer ribbon 120 that is at least as long as the longest circumference of the one or more feed rollers 159 of the device 100. This ensures that the entire surface 182 of each of the feed rollers 159 (FIG. 4) that engages the ribbon 120 is cleaned by the roller cleaning section 190.

In some embodiments, the one or more roller cleaning sections 190 are located at a trailing end of the transfer ribbon 120 relative to the feed direction 204. In some embodiments, the print sections 198 are only located on the leading end side of the roller cleaning sections 190. In this configuration, the cleaning operation is performed on the one or more feed rollers 159 after the print sections 198 have been used or processed by the device 100. For example, a leading end of the transfer ribbon 120 is initially wound on the take-up spool 127 (FIG. 1). During use, printing and laminating operations may be performed using the print sections 198 as the transfer ribbon 120 is wound on the take-up spool 127. After further use of the transfer ribbon 120, the one or more roller cleaning sections 190 at the trailing end portion 206 (FIG. 5) of the transfer ribbon 120 perform cleaning operations on the one or more feed rollers 159 of the device 100. The transfer ribbon 120 may then be fully wound on the take-up spool 127, and discarded by the user. Thus, the one or more feed rollers 159 of the device 100 are cleaned at the end of the life of the consumable transfer ribbon 120 and prior to the use of a new transfer ribbon 120, when the trailing end portion of the transfer ribbon 120 includes the one or more roller cleaning sections 190.

In some embodiments, the leading end of the transfer ribbon 120 includes one or more roller cleaning sections 190. In some embodiments, the print sections 198 are located only on the trailing end side of the roller cleaning sections 190. Here, the portion 206 of the transfer ribbon 120 shown in FIG. 5 may be considered the leading end of the transfer ribbon, when the feed direction is opposite that of arrow 204. In accordance with this embodiment, when the portion 206 transfer ribbon 120 is initially installed in the device 100 and fed through the device 100 in the direction opposite arrow 204, the one or more roller cleaning sections 190 of the transfer ribbon 120 clean the surfaces 182 of the one or more feed rollers 159 prior to the commencement of printing and laminating operations using the transfer ribbon 120. Subsequent to the roller cleaning operations using the sections 190, printing and laminating operations may be performed using the print sections 198 as the transfer ribbon 120 is wound on the take-up spool 127.

Figure 7:
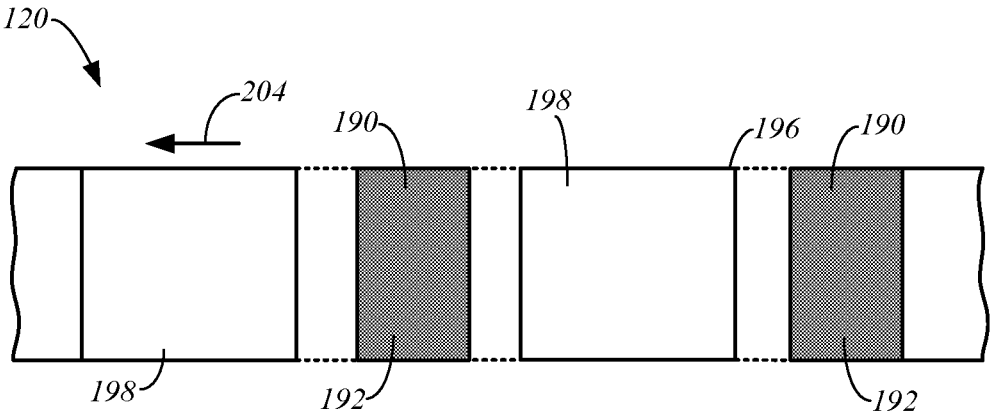
FIG. 7 is a simplified top view of a transfer ribbon in accordance with exemplary embodiments of the present disclosure.

In yet another embodiment, the transfer ribbon 120 includes one or more roller cleaning sections 190 that are located between print sections 198 of the transfer ribbon 120, as shown in FIG. 7, which is a simplified top view of a transfer ribbon 120 in accordance with exemplary embodiments of the present disclosure. This allows for periodic cleaning of the surfaces of the one or more feed rollers during use of the transfer ribbon 120. For example, after one or more printing or laminating operations are performed using the print sections 198, a roller cleaning operation is performed using one of the roller cleaning sections 190. The ribbon 120 is then fed in the feed direction 204 and one or more printing or laminating operations may be performed using the print sections 198 located downstream from the used roller cleaning section 190 relative to arrow 204. This process may be repeated using downstream roller cleaning sections 190 and print sections 198.

Embodiments of the transfer ribbon 120 include combinations of the above-described embodiments. Thus, the transfer ribbon 120 may include roller cleaning sections 190 at the trailing end, the leading end, and/or between print sections 198.

In some embodiments, the transfer ribbon 120 includes one or more indicium 210 (FIG. 5) for each roller cleaning section 190 that can be detected by one or more sensors 212 (FIG. 1) of the device 100 to detect the position of the one or more roller cleaning sections 190. Thus, each of the indicia 210 are in a predetermined location relative to a corresponding roller cleaning section 190. In some embodiments, the indicia 210 are located upstream from the corresponding roller cleaning section 190 relative to the feed direction 204. In some embodiments, the sensors 212 are conventional sensors, such as, for example, optical sensors that are configured to detect the indicia 210. The indicia 210 can take on any suitable form and shape. For example, the indicia can be optically transmissive or optically opaque. In one exemplary embodiment, the indicia 210 includes a suitable mark that blocks ultraviolet light.

Detection of the indicia 210 using the one or more of the sensors 212 notifies the controller 102 of the location of the one or more roller cleaning sections 190, and allows the controller 102 to control the feeding of the transfer ribbon 120 through the device 100 to perform the desired cleaning operation on the surfaces of the one or more feed rollers. Additionally, detection of the indicia 210 allows the controller 102 to adjust the components of the device 100 as desired. For example, in some embodiments, the controller 102 adjusts the position of the print head 144 using the mechanism 148 to disengage the print head 144 from the transfer ribbon 120, such as to avoid contacting the roller cleaning sections 190 of the transfer ribbon 120. Similarly, in some embodiments, the controller 102 uses the sensing of the indicia 210 to move the laminating roller 152 such that it becomes disengaged from the transfer ribbon 120 using the mechanism 156, such as to avoid contacting the roller cleaning sections 190 of the transfer ribbon 120.

In some embodiments, the transfer ribbon 120 includes a clear section 214 between the indicium 210 and the corresponding roller cleaning section 190, as shown in FIG. 5. In some embodiments, the clear section 214 is formed entirely of the carrier layer 196 or 130.

Figure 8:
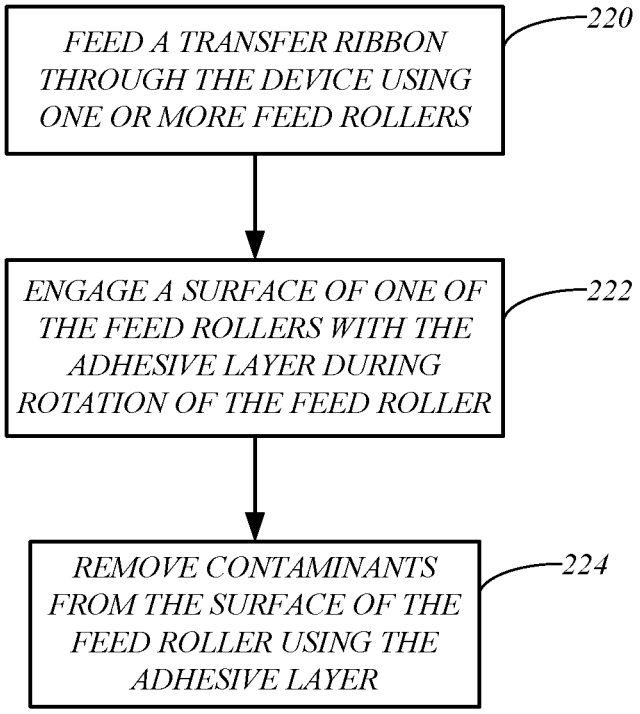
FIG. 8 is a flowchart illustrating a method of cleaning a surface of a feed roller in a credential production device, in accordance with embodiments of the present disclosure.

FIG. 8 is a flowchart illustrating a method of cleaning a surface 182 of a feed roller 159 in a credential production device 100 using the transfer ribbon 120, in accordance with embodiments of the present disclosure. The method may be performed using the controller 102, such as in response to the execution of program instructions stored in memory 103 (FIG. 1), for example.

At 220 of the method, the transfer ribbon 120 is fed through the device using one or more of the feed rollers 159. The transfer ribbon 120 is formed in accordance with one or more embodiments described herein. In some embodiments, the transfer ribbon 120 includes at least one print section that includes a print intermediate, such as a transfer layer 128 (FIG. 2) or a patch 140 (FIG. 3), and a roller cleaning section 190 including an adhesive layer 192 (FIGS. 5 and 6).

At 222 of the method, the adhesive layer 192 of the roller cleaning section 190 engages a surface 182 (FIG. 4) of one of the feed rollers 159 during rotation of the feed roller 159. Contaminants are removed from the surface 182 during step 222 using the adhesive layer in response to the engaging step 222, as indicated at 224.

In some embodiments, during step 222 of the cleaning operation, rolling contact occurs between the surface 182 of the feed roller 159 and the surface 194 of the adhesive layer 192 of the roller cleaning section 190. As used herein, the term "rolling contact" means that the points of contact between the surface 182 of the feed roller 159 and the surface 194 of the roller cleaning section 190 move together in the feed direction (arrow 204), and do not slide relative to each other. Thus, in some embodiments, the feed roller cleaning operation does not include abrasive or sliding contact between the surfaces of the feed rollers 159 and the roller cleaning sections 190.

In some embodiments of the method, the one or more roller cleaning sections 190 are located at a trailing end portion 206 of the transfer ribbon 120, as shown in FIG. 5. Here, embodiments of the method include performing one or more printing or laminating operations using the print sections 198 during the feeding step 220 and before the roller cleaning operation of steps 222 and 224.

In some embodiments of the method, the one or more roller cleaning sections 190 are located at a leading end portion of the transfer ribbon 120. As discussed above, this is generally illustrated in FIG. 5 where the feed direction is opposite that indicated by arrow 204. Here, embodiments of the method include performing one or more printing or laminating operations using the print sections 198 following the cleaning operation steps 222 and 224.

The one or more roller cleaning sections 190 may also be located between print sections 198, as shown in FIG. 7. Here, embodiments of the method include performing one or more printing or laminating operations using the print sections 198 before and after the roller cleaning operation of steps 222 and 224.

In some embodiments of the method, an indicium 210 (FIG. 5) corresponding to the roller cleaning section 190 to be used in the steps 222 and 224 is detected, prior to performing the roller cleaning steps 222 and 224. This detection of the indicium 210 may be performed using a suitable sensor 212 (FIG. 1) of the device 100 using the controller 102.

In some embodiments, the controller moves a processing component (e.g., print head 144, laminating roller 152) out of engagement with the transfer ribbon 120 in response to the detection of the indicium 210 to avoid contact between the processing component and the roller cleaning section 190. For example, the controller 102 may move the print head 144 out of engagement with the transfer ribbon 120 using the lift mechanism 148, and/or the controller may move the laminating or transfer roller 152 out of engagement with the transfer ribbon 120 using the lift mechanism 156, in response to the detection of the indicium.

Although the embodiments of the present disclosure have been described with reference to preferred embodiments, workers skilled in the art will recognize that changes may be made in form and detail without departing from the spirit and scope of the present disclosure.

What is claimed is:

1. A transfer ribbon comprising:

at least one print section each comprising a print intermediate; and one or more roller cleaning sections, each roller cleaning section comprising an adhesive layer;

wherein the one or more roller cleaning sections include at least one of a roller cleaning section at a trailing end of the transfer ribbon, and a roller cleaning section at a leading end of the transfer ribbon.

2. The transfer ribbon according to claim 1, wherein each of the one or more roller cleaning sections includes a carrier layer, and the adhesive layer is attached to the carrier layer.

3. The transfer ribbon according to claim 1, wherein the one or more roller cleaning sections include a roller cleaning section between a pair of print sections.

4. The transfer ribbon according to claim 1, wherein:

an exposed surface of each print intermediate of the at least one print section is on a first side of the transfer ribbon; and an exposed surface of the adhesive layer of each of the one or more roller cleaning sections is on a second side of the transfer ribbon that is opposite the first side.

5. The transfer ribbon according to claim 1, wherein:

an exposed surface of each print intermediate of the at least one print section is on a first side of the transfer ribbon; and an exposed surface of the adhesive layer of each of the one or more roller cleaning sections is on the first side of the transfer ribbon.

6. The transfer ribbon according to claim 1, wherein the one or more roller cleaning sections include a first roller cleaning section having an exposed surface of the adhesive layer on a first side of the transfer ribbon, and a second roller cleaning section having an exposed surface of the adhesive layer on a second side of the transfer ribbon that is opposite the first side.

7. The transfer ribbon according to claim 1, further comprising at least one indicium in a predetermined position relative to one of the roller cleaning sections, the at least one indicium detectable by a sensor.

8. The transfer ribbon according to claim 1, wherein the print intermediate of the at least one print section is selected from the group consisting of a transfer layer and an overlaminate patch.

9. A method of cleaning a surface of a feed roller in a credential production device comprising:

feeding a transfer ribbon through the device using one or more feed rollers in a feed direction, the transfer ribbon comprising:

at least one print section comprising a print intermediate; and one or more roller cleaning sections each comprising an adhesive layer;

wherein the one or more roller cleaning sections include at least one of a roller cleaning section at a trailing end of the transfer ribbon relative to the feed direction, and a roller cleaning section at a leading end of the transfer ribbon relative to the feed direction; and cleaning a surface of one of the feed rollers during feeding the transfer ribbon comprising steps of:

engaging a surface of the feed roller with the adhesive layer of a first of the one or more roller cleaning sections during rotation of the feed roller; and removing contaminants from the surface of the feed roller using the adhesive layer of the first roller cleaning section in response to the engaging step.

10. The method according to claim 9, wherein the engaging step comprises rolling contact between the surface of the feed roller and the adhesive layer of the first roller cleaning section.

11. The method according to claim 9, further comprising performing at least one process on one of the print intermediates selected from the group consisting of:

printing an image on a print surface of the print intermediate using a printing device of the credential production device; and laminating the print intermediate to a substrate using a laminating device of the credential production device.

12. The method according to claim 11, wherein:

the first roller cleaning section is located at the trailing end of the transfer ribbon; and performing at least one process on one of the print intermediates occurs before cleaning the surface of one of the feed rollers.

13. The method according to claim 11, wherein:

the first roller cleaning section is located at the leading end of the transfer ribbon; and performing at least one process on one of the print intermediates occurs after cleaning the surface of one of the feed rollers.

14. The method according to claim 11, wherein:

the first roller cleaning section is located between the leading and trailing ends of the transfer ribbon; and performing at least one process on one of the print intermediates occurs one of after cleaning the surface of one of the feed rollers, and before cleaning the surface of one of the feed rollers.

15. The method according to claim 11, further comprising detecting an indicium corresponding to the first roller cleaning section using a sensor, and disengaging one of a print head and a laminating roller from the transfer ribbon in response to detecting the indicium.

* * * * *